United States Patent [19]

von Lutzow

[11] 4,159,805

[45] Jul. 3, 1979

[54] BUBBLER SPRINKLER

[76] Inventor: Robert W. von Lutzow, 4840 Grandview La., Phoenix, Ariz. 85018

[21] Appl. No.: 848,984

[22] Filed: Nov. 7, 1977

[51] Int. Cl.[2] ..... B05B 1/30

[52] U.S. Cl. ..... 239/457; 239/524; 239/539; 239/542

[58] Field of Search ..... 239/107, 457, 458, 514, 239/523, 539, 541, 542, 581, 524

[56] References Cited

U.S. PATENT DOCUMENTS

| | | | |
|---|---|---|---|
| 1,143,700 | 6/1915 | Hamill | 239/457 |
| 2,055,366 | 9/1936 | Schrader | 239/457 X |
| 2,650,132 | 8/1953 | Reinecke | 239/542 |
| 3,045,926 | 7/1962 | Steinen | 239/457 |
| 3,219,278 | 11/1965 | Santarelli | 239/541 X |
| 3,756,515 | 9/1973 | Arnold | 239/524 |

*Primary Examiner*—John J. Love
*Attorney, Agent, or Firm*—Warren F. B. Lindsley

[57] ABSTRACT

A bubbler type sprinkler head for providing controlled water flow by means of an easily adjustable head eliminating all metallic parts of the prior art structures that corrode or induce scaling of the water in the bubbler head.

4 Claims, 4 Drawing Figures

BUBBLER SPRINKLER

BACKGROUND OF THE INVENTION

This invention relates to underground lawn, garden and shrubbery bubbler and sprinkler systems, and more particularly to an improved bubbler head which may be formed of non-metallic parts that may be easily adjusted for water volume control without tools which will hold its setting over an indefinite period of time and may be easily adjusted to remove any clogging materials.

DESCRIPTION OF THE PRIOR ART

Although it is known that many types of sprinkler and bubbler heads exist, patents, if any, on these products are not known by the applicant and accordingly can not be identified at this time. However, most prior art bubbler and sprinkler head structures are difficult to adjust and maintain in adjustment, especially of the trickle flow type, since they utilize metal screw type adjustments which corrode or which destroy their threaded fittings upon a few adjustment attempts.

SUMMARY OF THE INVENTION

In accordance with the invention claimed, a new and improved bubbler head is provided for a water irrigation system which is formed of non-metallic parts, such as from suitable plastics which do not corrode or are not effected by electrolysis and may be easily adjusted and retain its adjustment for long periods of time to provide the right amount of water for the item or area being watered. The bubbler head is easily hand adjusted to remove any clogging or water flow restricting debris by a slight turning of the bubbler head which flushes out the internal parts of the bubbler after which the bubbler head is turned back to its desired water controlled flow.

It is, therefore, one object of this invention to provide a new and improved bubbler head for a water irrigation system.

Another object of this invention is to provide an improved bubbler head for a water irrigation system that can be adjusted without tools to control water flow by a slight rotating movement of the deflecting head of the bubbler.

A further object of this invention is to provide an improved bubbler head for an irrigation system employing a relatively large orifice for water flow even at a reduced rate thereby eliminating clogged orifices.

A still further object of this invention is to provide an improved bubbler head for irrigation systems the head of which controls the water flow orifice and which may be easily rotated to quickly open the orifice to flush out any debris caught therein.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing, in which.

DESCRIPTION OF THE PREFERRED EMBODIMENT

Figure 1:
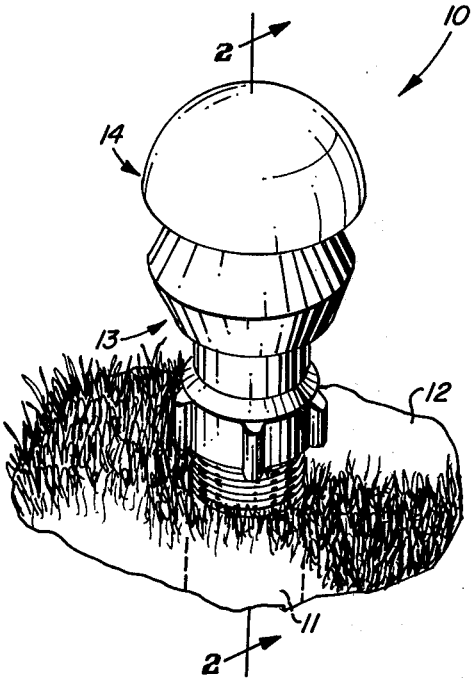
FIG. 1 is a perspective view of the bubbler head for an irrigation water system and embodying the invention.

Referring more particularly to the drawing by characters of reference, FIGS. 1–4 disclose a bubbler head 10 for an irrigation system 11 which may be placed under ground 12, if so desired for individually controlling the water flow to any growing item or area adjacent which it is placed. It should be realized that the irrigation system may be a simple or complex arrangement wherein a few or many sprinkler and bubbler heads may be spacedly arranged along a pipe line which may be valve operated at will or under the control of a time clock (not shown) in a well known manner.

The bubbler head 10 comprises a valve body having two telescopically threadedly interconnected tubular parts 13 or 14 which are so formed to control the flow of water out of the threaded outlet 15 the pipe forming the irrigation system 11.

Part 13 of the bubbler head 10 is provided with a ribbed end 16 which is provided with internal threads 17 for threadedly engaging with the threaded end 15 of the pipe of irrigation system 11. The other end 18 of part 13 of the bubbler head is provided internally with internal threads 19 for threadedly engaging with an externally threaded stem 20 of part 14 of the bubbler head.

Stem 20 of part 14 of the bubbler head is provided with a hollow axially arranged passageway 21 extending from end 22 of stem 20 into its dome shaped end 23. Midway or at any other suitable position between its ends but above its threaded portion the passageway 21 is provided with lateral interconnecting passageways 24 which open into a reservoir 25 formed by an axially arranged cylindrical bore 26 extending outwardly of the internal threads 19 of this part of the bubbler head.

Although passageways 24 interconnect with passageway 21 at right angles thereto any other angular connection is intended to fall within the scope of this invention.

Figure 2:
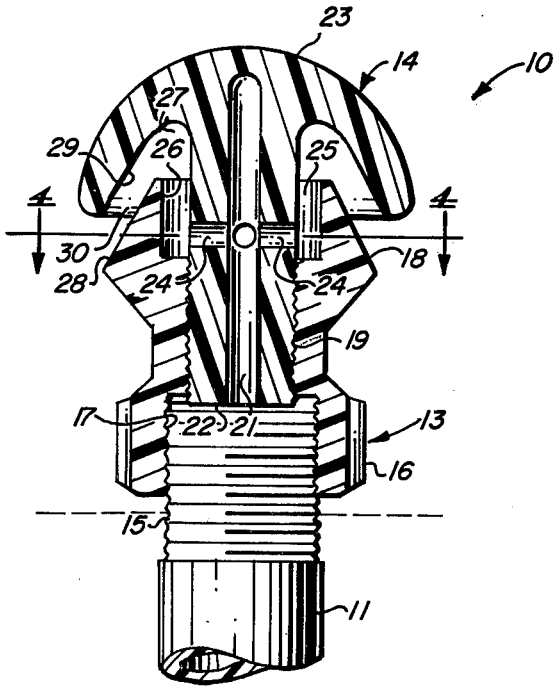
FIG. 2 is a cross-sectional view of FIG. 1 taken along the line 2—2.
Figure 4:
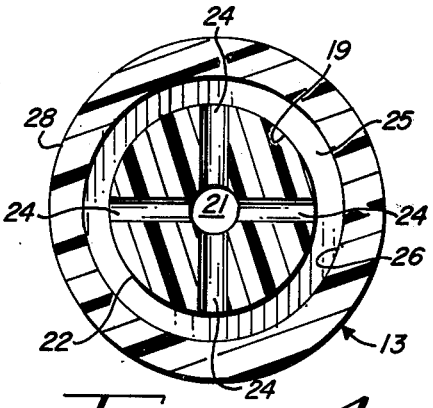
FIG. 4 is a cross-sectional view of FIG. 2 taken along the line 4—4.
Figure 3:
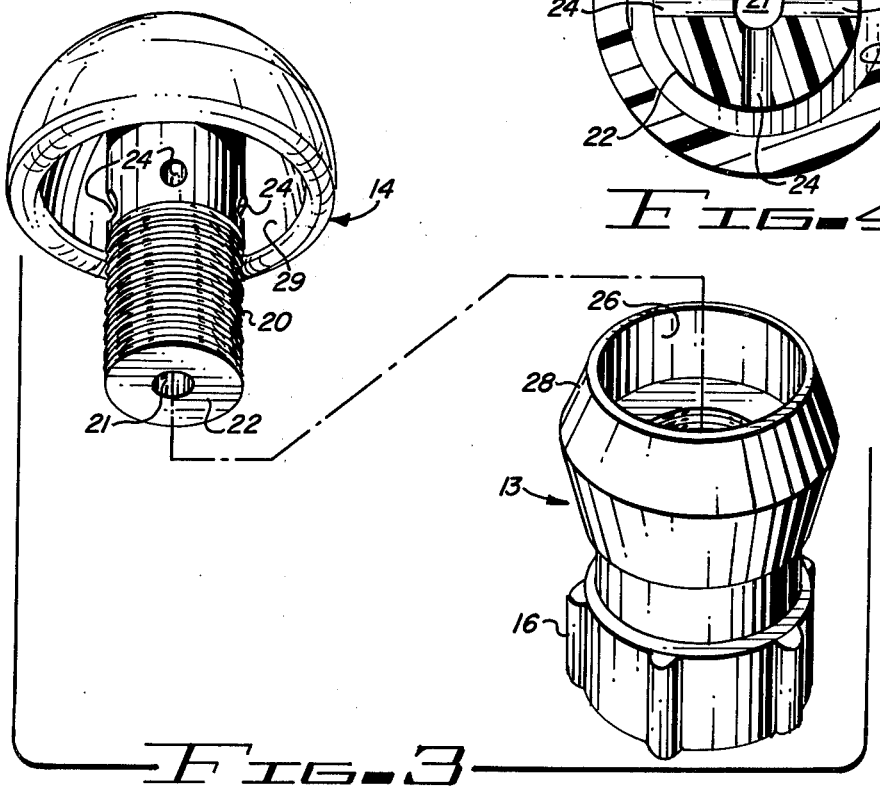
FIG. 3 is a perspective exploded view of the bubbler head shown in FIG. 1.

The inside of the dome shaped end 23 of part 14 of the bubbler head 10 is formed as an inverted dish 27 with the stem 20 axially extending outwardly thereof. When part 14 is threadedly interconnected with the threaded opening in part 13, as shown in FIG. 2, the position of lateral passageways 24 may be positioned relative to reservoir 25 depending on how far part 14 is threaded into part 13. It should be noted that the water flow through the bubbler head may be closed off completely by threading part 14 into part 13 until passageways 24 are blocked or substantially blocked by the thread 19 of part 13. Varying limited flows may be obtained by turning part 14 out of part 13 from its closed position to that shown in FIG. 2 where the bubbler head is substantially fully open to its maximum amount of water flow therethrough.

It should be noted that by utilizing the reservoir 25 an even controlled flow of water may be obtained for all of the bubbler head settings since water in the reservoir causes a steady flow all around the periphery of the dish shaped opening in part 14.

It should be obvious from FIG. 2 that the flow of water through the bubbler head may be easily and readily controlled by simply grasping the dome shape end of part 14 of the bubbler head and rotating it relative to part 13 thereof. This makes it possible to easily adjust the setting of the bubbler head but also to quickly flush out the head if it becomes clogged with debris.

As evident from FIG. 2, the outer periphery of the upper end of part 13 of the bubbler head is formed to provide a surface 28 around the part which cooperates with the inside surface 29 of the inverted dish shaped configuration 27 to provide a nozzle 29 which may have parallel or tapered internal surfaces.

The bubbler head is also relatively easy to install on threaded end of a stand pipe of the irrigation system by grasping the form fitting exterior of part 13 and threading it onto the threaded end of the pipe of the irrigation system 11.

Although it is desirable to make the bubbler head out of suitable plastic parts, it may be made out of metal or other materials but metal may rust and support electrolysis thereby eliminating some of the benefits of the disclosed structure. Since this bubbler head comprises only two parts it may be easily and economically manufactured.

Although but one embodiment of this invention has been illustrated and described, it will be apparent to those skilled in the art that various changes and modifications may be made therein without departing from the spirit of the invention or from the scope of the appended claims.

What is claimed is:

1. A bubbler head for an irrigation system comprising:

a valve body comprising two axially interconnected elongated hollow parts, one end of one of said parts being internally threaded for threadedly engaging a threaded pipe of an irrigation system, the other end of said one of said parts being internally threaded for threadedly receiving the other of said parts, the other of said parts being provided with an end having a dish shaped configuration having an externally threaded stem of smaller diameter than the outer diameter of said dish shaped configuration extending axially out of said dish shaped configuration, said stem threadedly engaging with the threads of said other end of said one of said parts for moving a predetermined distance, said stem being provided with a first passageway extending axially from its free end toward said dish shaped configuration, a second passageway interconnecting with said first passageway between its ends and extending laterally thereof to the outside periphery of said stem, said first part being provided with a bore extending into said other end thereof a predetermined distance and being of a larger diameter than the diameter of said stem to provide a reservoir for water around said stem, said second passageway interconnecting with said reservoir during a part of said predetermined movement of said stem, said stem during said predetermined movement moving said second passageway gradually out of alignment with said reservoir to control water flow through the first and second passageways into said reservoir and against said dish shaped configuration for deflection out of said bubbler head.

2. The bubbler head set forth in claim 1 wherein:

said second passageway comprises a plurality of passageways spacedly positioned around said stem.

3. The bubbler head set forth in claim 1 wherein:

said plurality of passageways are equally spaced around said stem.

4. The bubbler head set forth in claim 3 wherein:

said plurality of passageways are positioned at a point on said stem between its threads and the dish shaped end of said other part.

* * * * *